US005294215A

United States Patent [19]

Millgard

[11] Patent Number: 5,294,215

[45] Date of Patent: Mar. 15, 1994

[54] METHOD FOR CONSTRUCTING FOUNDATIONS AND PERIMETER WALLS

[75] Inventor: V. Dennis Millgard, Orchard Lake, Mich.

[73] Assignee: The Millgard Corporation, Livonia, Mich.

[21] Appl. No.: 992,062

[22] Filed: Dec. 17, 1992

[51] Int. Cl.[5] ..... E02D 29/00

[52] U.S. Cl. ..... 405/266; 405/233; 405/267

[58] Field of Search ..... 405/266, 267, 258, 229, 405/230, 233, 240–243

[56] References Cited

U.S. PATENT DOCUMENTS

| | | | |
|---|---|---|---|
| 3,800,544 | 4/1974 | Nakanishi | 405/266 |
| 3,969,902 | 7/1976 | Ichise et al. | 405/266 X |
| 5,013,185 | 5/1991 | Taki | 405/266 X |

*Primary Examiner*—Dennis L. Taylor
*Attorney, Agent, or Firm*—Lloyd M. Forster

[57] ABSTRACT

An adaptation of apparatus disclosed in U.S. Pat. No. 5,135,058 to provide foundations or perimeter walls is effected with the drilling of circular holes within a range of four to sixteen feet overlapping to provide continuous area coverage in the case of foundations with a minimum of overlap and to provide a minimum wall thickness in the order of hole radius in the case of containment walls.

1 Claim, 1 Drawing Sheet

METHOD FOR CONSTRUCTING FOUNDATIONS AND PERIMETER WALLS

BACKGROUND OF THE INVENTION

U.S. Pat. No. 5,135,058 discloses Crane-Mounted Drill and Method for In-Situ Treatment of Contaminated Soil for purposes of treating an entire field of contaminated soil. FIG. 9 of such patent illustrates a drilling pattern that may be implemented using the apparatus of the invention comprising substantially cylindrical holes drilled in succession in parallel laterally adjacent rows, The drill bit may then be changed to a drill of smaller diameter and "rosebuds" between holes may be covered by a succession of interstitial holes to effectively treat the entire field.

BRIEF DESCRIPTION OF THE INVENTION

The apparatus of such patent has now been adapted to construct perimeter walls and substantial area foundations utilizing a circular drill pattern providing complete area coverage with minimum overlap and without requirement for change of drill size.

The apparatus can be effectively employed to drill holes of any diameter within a range of four feet to sixteen feet; and for any given site an appropriate diameter may be selected by determining the number of holes required under the table of dimensions disclosed hereafter in this specification.

Instead of employing a drilling pattern such as illustrated in FIG. 9 of said patent, the present method employs a pattern of holes of equal diameter offset in alternate rows, to effect the complete area coverage. In the case of the perimeter wall, a uniform spacing of hole centers is employed around the entire perimeter to provide an appropriate overlap for containment purposes.

DETAILED DESCRIPTION OF PREFERRED METHOD

Figure 1:
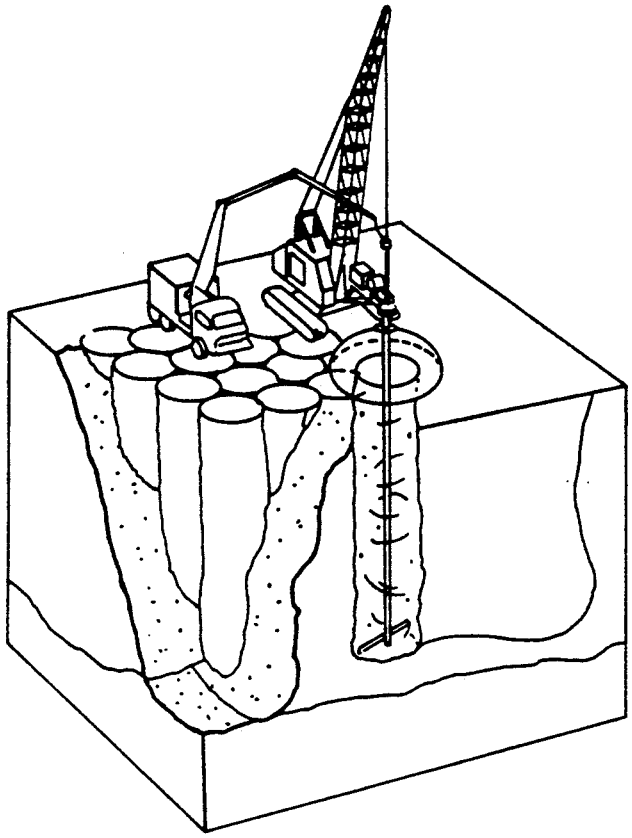
FIG. 1 is a schematic perspective view of a foundation site with holes drilled in accordance with the present invention.
Figure 2:
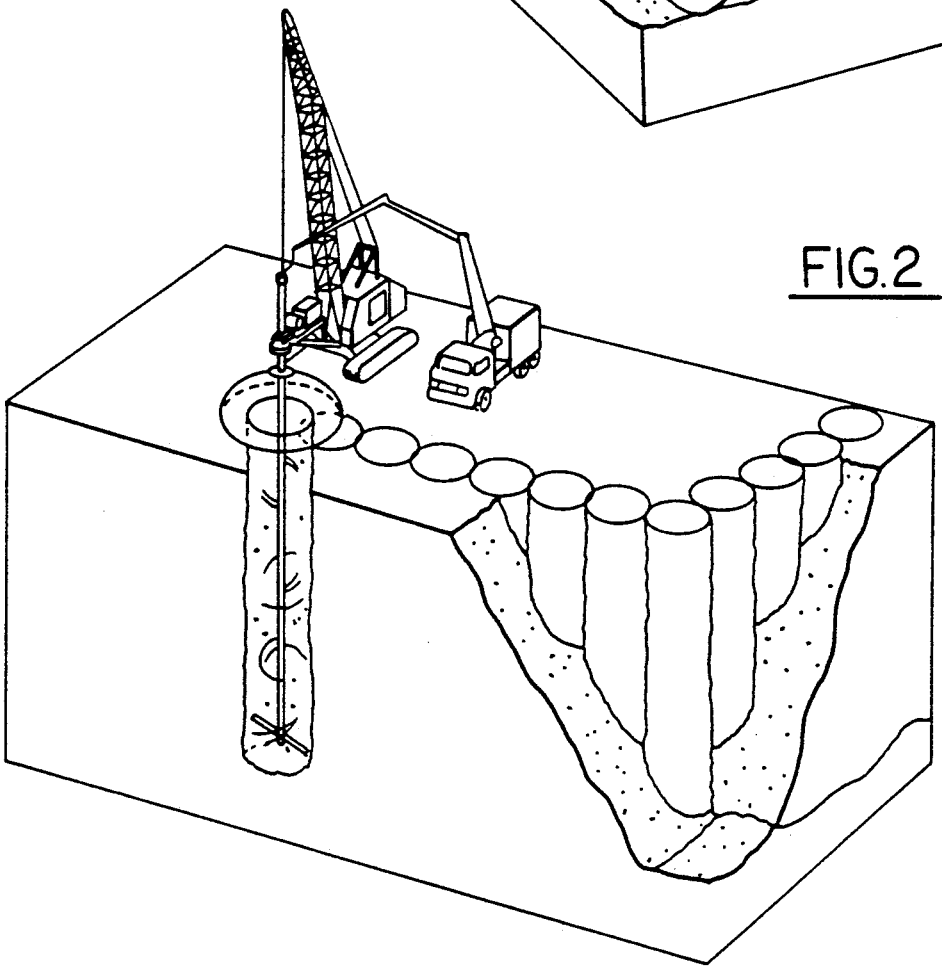
FIG. 2 is a schematic perspective view of a perimeter wall site with holes drilled in accordance with the present invention.

In providing a complete area coverage foundation in accordance with the present method, a given site, typically rectangular, is laid out on a scale plan view to establish hole centers for the particular drill size to be employed. Starting with one corner, the longitudinal side of the rectangle is provided with an "X" hole spacing equal to 0.866 times the diameter of the drill located along a line substantially equal to one quarter of the hole diameter inwardly spaced from the border edge of the required foundation, and with the first hole center located on the end border edge of the foundation. A second row of hole centers is then located midway between the hole centers of the first row at a "Y" spacing perpendicular to "X" equal to 0.75 times the drill diameter. Successive rows of hole centers are then laid out in duplicate configuration to the first two rows to approach the extremities of the foundation area. The entire hole center pattern may then be shifted outwardly of the starting corner to balance the pattern of hole centers within the foundation area.

Nonrectangular foundation sites may be accommodated by similarly applying an "X"-"Y" grid of hole centers, using the 0.866 times diameter hole spacing for the longest dimension and 0.75 times diameter hole spacing for the "Y" shorter dimension.

In providing a perimeter wall, a preferred overlap established by the 0.866 hole center spacing is preferably employed along the entire perimeter with the centerline of the wall adapted to site requirements. Such spacing of the hole centers will result in minimum wall thickness equal to the radius of the drilled holes.

In order to complete the foundation or perimeter wall in accordance with the present invention, the apparatus of U.S. Pat. No. 5,135,058 for In-Situ Treatment of Contaminated Soil is employed to deliver foundation materials through the Kelly Bar as drilling progresses by injecting the appropriate slurry directly into the soil/sludge under high pressure, mixing same In-Situ with the soil to accomplish thorough mixing with the solidification agent without excavation. Movement of the drill rig from hole to hole is accomplished before solidification takes place and upon completion of the solidification, a complete coverage solid foundation, or perimeter wall as the case may be, is effectively provided.

In order to determine the number of holes required for a given rectangular area with minimum overlap, the following table can be employed by dividing the foundation area by the Effective Coverage of the drill diameter to be used. Adjustments to accommodate particular site configurations can then be made by scale layout of hole centers on each particular site plan.

Overlap Circle Configurations Layout Table

| Dia. Circle | SF | X (ft) | Y (ft) | Effective Coverage SF | % Overlap |
|---|---|---|---|---|---|
| 4.0' | 12.57 | 3.46 | 3.0 | 10.39 | 20.9 |
| 5.0' | 19.63 | 4.33 | 3.75 | 16.24 | 20.9 |
| 6.0' | 28.27 | 5.20 | 4.5 | 23.38 | 20.9 |
| 7.0' | 38.48 | 6.06 | 5.25 | 31.83 | 20.9 |
| 8.0' | 50.27 | 6.93 | 6.0 | 41.57 | 20.9 |
| 9.0' | 63.62 | 7.79 | 6.75 | 52.61 | 20.9 |
| 10.0' | 78.54 | 8.66 | 7.5 | 64.95 | 20.9 |
| 11.0' | 95.03 | 9.53 | 8.25 | 78.59 | 20.9 |
| 12.0' | 113.10 | 10.39 | 9.0 | 93.53 | 20.9 |
| 13.0' | 132.73 | 11.26 | 9.75 | 109.77 | 20.9 |
| 14.0' | 153.94 | 12.12 | 10.5 | 127.31 | 20.9 |
| 15.0' | 176.71 | 12.99 | 11.25 | 146.14 | 20.9 |
| 16.0' | 201.06 | 13.86 | 12.0 | 166.28 | 20.9 |

Divide area to be treated by Effective Coverage (SF) to get quantity of shafts at corresponding diameter. 20.9% overlap is ideal geometry. Field conditions will vary.

I claim:

1. Method for constructing in-situ a solid substantial area foundation characterized by successively sequentially drilling single overlapping equal diameter circular foundation holes within a range of four to sixteen feet in diameter successively filled with solidifying material in a pattern characterized by parallel rows of overlapping holes having centers equally spaced approximately 0.866 times drill diameter in an "X" direction, approximately 0.75 times drill diameter in a "Y" direction, and with alternate rows having centers medianly offset from the center of adjacent rows to thereby provide coverage of said substantial area with a mathematically exact minimum number of individual single drill holes having no interstitial spaces.

* * * * *